US008075365B2

(12) United States Patent
Schonert et al.

(10) Patent No.: US 8,075,365 B2
(45) Date of Patent: Dec. 13, 2011

(54) YO-YO HAVING A STRING-FORMED RESPONSE SYSTEM

(76) Inventors: Matthew C. Schonert, El Cajon, CA (US); Hans W. Van Dan Elzen, Gilbert, AZ (US)

( * ) Notice: Subject to any disclaimer, the term of this patent is extended or adjusted under 35 U.S.C. 154(b) by 251 days.

(21) Appl. No.: 12/575,353

(22) Filed: Oct. 7, 2009

(65) Prior Publication Data

US 2010/0022159 A1 Jan. 28, 2010

Related U.S. Application Data

(62) Division of application No. 11/388,667, filed on Mar. 23, 2006, now Pat. No. 7,621,796.

(51) Int. Cl.
*A63H 1/06* (2006.01)
*A63H 1/30* (2006.01)

(52) U.S. Cl. ..... 446/250; 446/247

(58) Field of Classification Search ..... 446/247–254
See application file for complete search history.

(56) References Cited

U.S. PATENT DOCUMENTS

| | | | | |
|---|---|---|---|---|
| 833,610 | A | 10/1906 | Liebreich | |
| 2,463,670 | A | 3/1949 | Yankelevitz | |
| 2,773,328 | A * | 12/1956 | Fraenkel et al. | 446/250 |
| 3,139,699 | A * | 7/1964 | Chuy et al. | 446/250 |
| 5,389,029 | A * | 2/1995 | McAvoy, Jr. | 446/250 |
| 5,769,686 | A * | 6/1998 | Duncan et al. | 446/250 |
| 5,813,897 | A * | 9/1998 | Van Dan Elzen et al. | 446/250 |
| 5,813,898 | A * | 9/1998 | Van Dan Elzen et al. | 446/250 |
| 5,951,361 | A * | 9/1999 | Van Dan Elzen et al. | 446/250 |
| 6,155,903 | A * | 12/2000 | Van Dan Elzen et al. | 446/250 |
| 6,213,838 | B1 * | 4/2001 | Amaral | 446/250 |
| 6,331,132 | B1 * | 12/2001 | Watson | 446/250 |
| 6,565,408 | B1 * | 5/2003 | Marcantonio et al. | 446/250 |
| 6,579,142 | B1 | 6/2003 | Rehkemper et al. | |
| 6,599,165 | B1 * | 7/2003 | Van Dan Elzen | 446/250 |
| 2004/0198151 | A1 * | 10/2004 | Bell | 446/247 |

* cited by examiner

*Primary Examiner* — Gene Kim
*Assistant Examiner* — Alyssa Hylinski
(74) *Attorney, Agent, or Firm* — Franklin Gubernick

(57) ABSTRACT

The invention is an improved yo-yo that has two side units and a string-formed response system incorporated into each side unit. In its most basic form, the response system employs a string that is threaded through spaced-apart apertures in a side unit to form at least one tether engagement pad. The pad may be contacted by the yo-yo's tether in order to cause a return of the yo-yo to a user's hand.

19 Claims, 10 Drawing Sheets

YO-YO HAVING A STRING-FORMED RESPONSE SYSTEM

This application is a divisional of U.S. patent application Ser. No. 11/388,667 filed Mar. 23, 2006 now U.S. Pat. No. 7,621,796. Said U.S. patent application Ser. No. 11/388,667 is hereby incorporated by reference.

FIELD OF THE INVENTION

The invention is in the field of user-manipulated toys. More particularly, the invention is an apparatus in the form of a yo-yo in which at least one of the yo-yo's side units includes a unique response system that enhances the yo-yo's performance. In its most basic form, the response system comprises a string that is threaded through a number of apertures in the side unit to thereby create at least one tether engagement pad that may be contacted by the yo-yo's tether.

BACKGROUND OF THE INVENTION

Most yo-yos are in the form of two disk-shaped side units that are rigidly connected to each other, in a spaced-apart relation, by some form of axle structure. The side units may be of a unitary or multi-part construction and are usually made out of plastic, wood and/or metal. The axle structure typically extends through the center of both side units and can be an assembly of multiple parts, or be a single part structure, such as a wooden dowel. To reduce friction, many modern yo-yos employ an axle structure that includes a center-located rotatable member as the point of attachment for the yo-yo's tether.

A yo-yo tether is commonly in the form of a long string that is made from a plurality of cotton strands that are twisted together. To enable the securement of the tether to the axle structure, one end of the tether is adapted to create a loop that is positioned to encircle a center portion of the axle structure. The other end of the tether is usually tied to create a second loop that can be placed about one of a user's fingers to thereby secure the tether, and effectively the yo-yo, to the user's hand.

When the tether is wound about the axle structure and the yo-yo is then released, or thrown, from the user's hand, the yo-yo will begin to rapidly spin as it moves away from the user's hand. This occurs as a result of the tether unwinding from about the axle structure. When the tether fully unwinds from about the axle structure, the yo-yo may "sleep" at the end of the tether, whereby the yo-yo's side units continue to spin without the tether rewinding on the axle structure. Once the yo-yo is sleeping, there are a number of tricks, such as "walk the dog," that a person can perform with the spinning yo-yo. A sleeping yo-yo is also often used to perform "string tricks" that involve temporarily placing the spinning yo-yo onto a portion of the tether intermediate of the tether's two ends.

Normally, at the finish of a yo-yo trick, the user of the yo-yo will make a quick jerk on the tether in order to have the yo-yo return to the user's hand. By jerking on the tether, the user causes a brief tightening of the tether, which is then automatically followed by a temporary slackening of the tether. Once the tether goes slack, the tether's twist will cause one or more portions of the tether located proximate the axle structure to move to the side, and thereby engage, a spinning portion of the yo-yo. Once an engagement has occurred, the tether portion can become locked to a spinning portion of the yo-yo. A locking engagement is usually due to the tether becoming snagged on a surface of the spinning portion, or to a bunching of the tether against said spinning portion. Once a locking engagement has occurred, further rotation of the spinning portion of the yo-yo winds the tether about the axle structure, thereby causing the yo-yo to return to the user's hand.

Every yo-yo has three crucial performance characteristics that determine its ability to perform tricks. They are the yo-yo's potential sleep time, its smoothness on the tether, and its ability to return on command.

Concerning a yo-yo's sleep time, the longer the yo-yo can be made to sleep, the more time a user will have to complete any particular yo-yo trick. It is well known that by minimizing friction in the yo-yo's components, one can maximize the yo-yo's sleep time. Furthermore, it is known that whenever the tether even slightly rubs against a spinning portion of the yo-yo, the created friction will reduce the yo-yo's sleep time.

Concerning a yo-yo's ability to be smooth on the tether, this refers to a yo-yo's ability, when it is sleeping at the end of the tether, to be temporarily placed on a medial portion of the tether without inadvertently returning to the user's hand. An example of a trick that requires a yo-yo to be smooth on the tether is "man on the trapeze." If, during such a trick, the spinning yo-yo can slide on the tether, the yo-yo is said to be very smooth on the tether.

The ability of a yo-yo to return on command is the primary measure of a yo-yo's responsiveness. Return on command refers to the ability of the yo-yo to return to the user's hand after the yo-yo is commanded to return via a quick jerk on the yo-yo's tether. The structure and design of the yo-yo must be such that when the tether briefly goes slack, a portion of the tether can move to the side and create a locking engagement with a spinning portion of the yo-yo. In most prior art yo-yos, the ability of the tether to become lockingly engaged to a spinning portion of the yo-yo is enhanced through the use of tether engagement adaptations located in, or on, the tether-facing surface of the yo-yo's side units. Examples of tether engagement adaptations known in the art include an array of raised ribs, indentations, and/or rubber pads. The tether-facing surface of a side unit is herein defined as the surface of the side unit that faces a portion of the yo-yo's tether when said tether extends straight out from the yo-yo's string gap. A yo-yo's string gap is herein defined as the area located between the yo-yo's side units.

While tether engagement adaptations, such as raised ribs, enhance a yo-yo's ability to return on command, they can adversely affect a yo-yo's sleep time and smoothness on the tether. For example, engagement adaptations that extend deeply into the string gap will usually cause an increase in the frequency of inadvertent contacts between the tether and the adaptations. An increase in inadvertent contacts will increase both friction and the likelihood of an inadvertent return of the spinning yo-yo when it is placed on a medial portion of the tether. The large number of different tether engagement adaptations found in the prior art reflect an effort by inventors to create yo-yos that are either specially adapted for the performance of certain types of yo-yo tricks, or that provide a unique compromise of yo-yo performance characteristics.

Watson (U.S. Pat. No. 6,331,132) teaches a yo-yo in which each side unit has a tether engagement adaptation in the form of a flat, ring-shaped pad of fibrous material. In the taught yo-yo, replacement of a worn pad can be onerous since the glue used to secure the pad can leave a residue on the side unit's tether-facing surface when the pad is removed. In addition, the pads provide no means for changing the yo-yo's responsiveness.

Van Dan Elzen et al (U.S. Pat. No. 5,813,898) teaches a different form of tether engagement adaptation. Spaced-apart pads of a relatively high-friction material are affixed to the tether-facing surface of each side unit. The pads provide no means for adjusting the yo-yo's responsiveness, and their removal can leave a glue residue on the tether-facing surface of each of the yo-yo's side units.

Most prior art yo-yos lack tether engagement adaptations that can be easily and quickly replaced once they become worn. In addition, prior art yo-yos usually also lack replaceable tether engagement members that are firmly secured to the associated yo-yo side unit without the use of an adhesive. Completely unknown in the prior art is a yo-yo in which the tether engagement adaptations can be replaced without requiring special replacement parts. Furthermore, prior art yo-yos lack adjustable tether engagement adaptations that can maximize the yo-yo's responsiveness and smoothness on the tether while minimizing the tendency for the yo-yo to inadvertently return to the user. As a result, there is a need for a yo-yo that has unique performance characteristics via replaceable, adjustable tether engagement adaptations that enable the yo-yo to be usable for all types of yo-yo tricks and by yo-yo players of all skill levels.

SUMMARY OF THE INVENTION

The invention is a yo-yo in which at least one of the yo-yo's side units includes a unique, string-formed response system that enhances the yo-yo's performance. In its most basic form, the response system comprises a string that is threaded through a plurality of apertures in the side unit and thereby creates at least one tether engagement pad that may be contacted by the yo-yo's tether. The string of the response system is preferably identical in material and structure to a conventional yo-yo tether.

In a first embodiment of the invention, each of the yo-yo's side unit's has a disk-shaped body member that includes a plurality of apertures/thru-bores. The string of the response system is threaded through said apertures/thru-bores to create at least one tether engagement pad. The string's end portions are secured adjacent an outer portion of the side unit.

In another embodiment of the invention, each of the yo-yo's side units has a shuttle that is preferably capable of being adjustably positioned by a user. Each shuttle includes at least one tether engagement pad formed by a string threaded through apertures in the shuttle.

In a third embodiment of the invention, each of the yo-yo's side unit's has a response system that employs a string threaded through a plurality of apertures defined by curved portions of hook members. The hook members are movable via a user-actuable, spring-loaded button member, and portions of the string located between the hook members create tether engagement pads.

While the response system's string can be employed to form a single tether engagement pad, it is preferred that the string form a plurality of tether engagement pads. When the string is used to form multiple tether engagement pads, said pads may either be spaced apart from each other, or be contiguous to each other.

A response system in accordance with the invention employs a unique structure that gives it a functionality not found in the prior art. In this manner, the invention provides numerous advantages over the prior art.

Firstly, the response system's tether engagement pad(s) can be easily replaced when it (they) become worn. This is accomplished by merely removing the string that forms a side unit's pad(s) and threading a new string into the side unit. A user can also renew the response system by rethreading the string in a manner whereby new portions of said string can become positioned to replace all, or part, of the pad(s).

Secondly, the securement methods taught herein for the string provide an extremely secure and glue-free anchoring of the tether engagement pad(s). A user can quickly and easily change the tether engagement pad(s) without having to spend extra time and effort cleaning a side unit's tether-facing surface.

Thirdly, when the tether engagement pad(s) require replacement, special replacement parts are not required. To replace the string that forms the pad(s), a user can just thread a standard yo-yo tether into the side unit's apertures and then cut-off any extra material.

Fourthly, each tether engagement pad created by the string has a tether engagement surface that, in cross-section, extends in a full 180 degree arc. This is unlike prior art pads that have a flat surface perpendicular to the yo-yo's axis of rotation. By offering angled surfaces, a tether engagement pad in accordance with the invention has surfaces that can match the contours of angled portions of said tether created when the tether is in a slackened condition. This effectively increases the area of the pad that can contact an angled portion of the tether when the user is trying to have the yo-yo return on command. This also minimizes the pad surface area available to inadvertently come in contact with the tether.

Fifthly, responsiveness is also maximized when the string used to form the tether engagement pad(s) is made of the same fibrous material as the yo-yo's tether. The use of identical fibrous materials facilitates a locking engagement when the tether contacts an engagement pad. This results when the outwardly extending fibers of the pad(s) and the yo-yo's tether intertwine to facilitate a locking engagement between the tether and a pad.

Sixthly, a user can easily change the yo-yo's responsiveness by changing the tension in the string that forms the tether engagement pad(s). When the string tension is increased, the pad(s) become compressed. This creates a situation where a tether portion has to travel a greater distance to contact a pad, with a consequent decrease in the yo-yo's responsiveness. If one instead decreases the tension in the string, the pad(s) will bulge outwardly, toward the tether, whereby the yo-yo will tend to become more responsive due to the shorter distance the tether has to travel to contact a pad.

Lastly, the yo-yo's responsiveness can also be easily changed by removing the string that forms the tether engagement pad(s) and replacing it with another string that has a different thickness, and/or is made from a different material and/or has different surface characteristics. For example, a user can reduce the yo-yo's responsiveness by removing an existing cotton string and replacing it with a smooth, polyester string.

The invention is therefore a yo-yo that is easily adaptable for the performance of most yo-yo tricks and can be readily used by either a beginner or an experienced yo-yo player. The yo-yo's responsiveness is fully adjustable and all three of the previously noted yo-yo performance characteristics can be selectively maximized. A yo-yo in accordance with the invention can take the place of a large number of more specialized yo-yos, thereby negating any need for a user to own, maintain and transport multiple different yo-yos.

DETAILED DESCRIPTION OF THE DRAWINGS

Figure 1B:
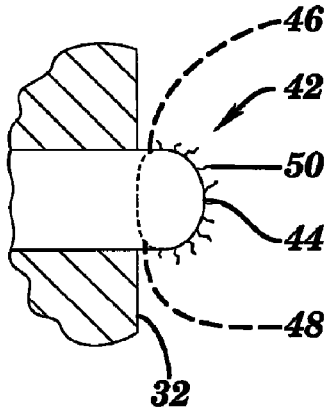
FIG. 1B shows a magnified portion of FIG. 1A, with portions shown in phantom.

Looking now to the drawings in greater detail, wherein like reference numerals refer to like parts throughout the several figures, there is indicated by the numeral 1 a yo-yo in accordance with the invention.

The yo-yo 1 includes first and second side units 2 that are preferably substantially identical and are connected together via an axle structure 4. A string-type tether 6 includes a loop portion 8 that encircles a center portion of the axle structure. The tether's distal end (not shown) will normally be tied to create a loop that enables a temporary securement of said end to one of a user's fingers.

The axle structure 4 is preferably an assemblage of parts that includes an axle pin 10 and a ball bearing unit 12. The axle pin has threads 14 at each end and a longitudinal axis that is co-linear with the yo-yo's axis of rotation when the yo-yo is sleeping at the end of the tether.

The ball bearing unit 12 is preferably conventional in design and is shown centered on the axle pin where it is sandwiched between two spacers 16. The spacers are preferably made of a metal material and each includes a nipple portion 18 that contacts the ball bearing unit's inner race 20. In this manner, there is a space adjacent the ball bearing unit's outer race 22 that allows said outer race to spin freely. It should be noted that other types of rotatable units or members can be employed in place of the ball bearing unit shown. Alternatively, the ball bearing unit can be dispensed with when the yo-yo's tether is attached directly to the axle pin, or to a structure fixedly secured to said pin, or to an equivalent structure that connects the yo-yo's side units together.

Each side unit 2 includes a disk-shaped body member 24 that has a center-located thru-bore 26. Non-rotatably secured within an expanded portion of said bore is a nut 30 that is considered to be a part of the axle structure and has interior threads adapted to threadedly engage the exterior threads 14 of the axle pin 10. When opposite ends of the axle pin are engaged to the nut 30 in each side unit, the axle structure will function to secure together the two side units in a spaced-apart relation.

The body member 24 has an inwardly-facing surface 32 and an outwardly-facing surface 34. Surface 32 is also herein referred to as a tether-facing surface since at least a portion of said surface will face the yo-yo's tether 6 when said tether is secured to the axle structure and extends outwardly from the yo-yo's string gap. Surface 34 is considered an outwardly-facing surface since it faces away from the yo-yo's string gap.

Surface 32 surrounds a circular cavity 36 into which is received one of the spacers 16. Also located in said surface are a plurality of apertures 38. The apertures are positioned in a circular array and are uniformly spaced from each other. The apertures are also equidistantly spaced from the body member's thru-bore 26.

Apertures 38 are preferably in the form of thru-bores that extend through the body member. In this manner, the apertures are located in both of the body member's surfaces 32 and 34. In the preferred embodiment, each of the yo-yo's side units has eight apertures 38. Preferably, each aperture is circular and has a diameter of about one-tenth of an inch. A greater, or fewer, number of apertures may be employed. In addition, the apertures may be thru-holes, openings, passages or slots having circular or non-circular shapes and/or a diameter larger or smaller than the preferred diameter.

Figure 1A:
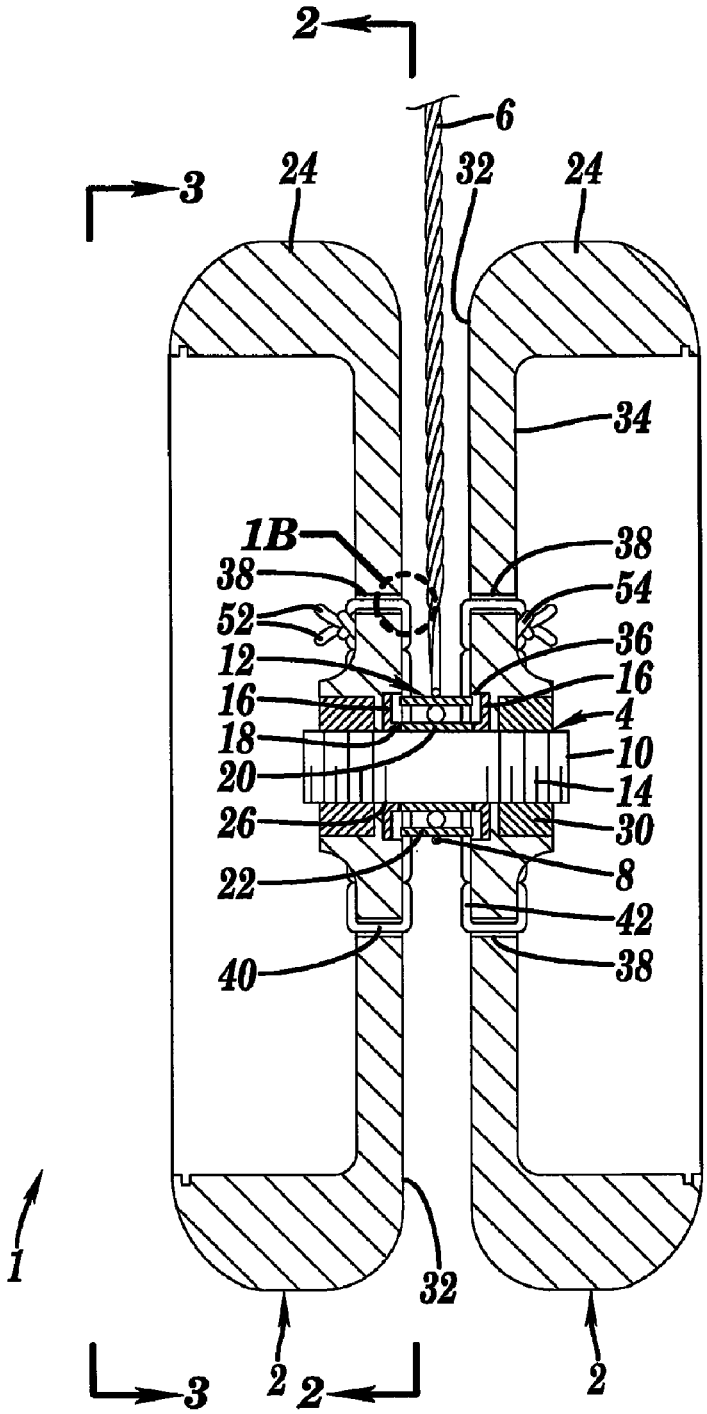
FIG. 1A is a cross-sectional front view of a first embodiment of a yo-yo in accordance with the invention.
Figure 3:
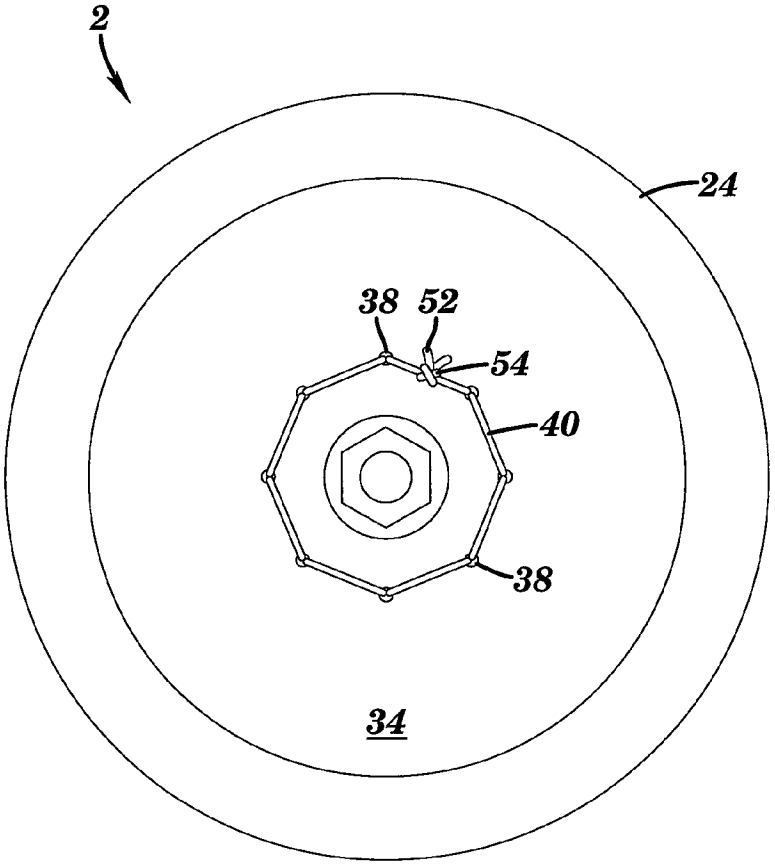
FIG. 3 is a side view showing the outwardly-facing surface of the side unit shown in FIG. 2, taken at the plane labeled 3-3 in FIG. 1A.
Figure 2:
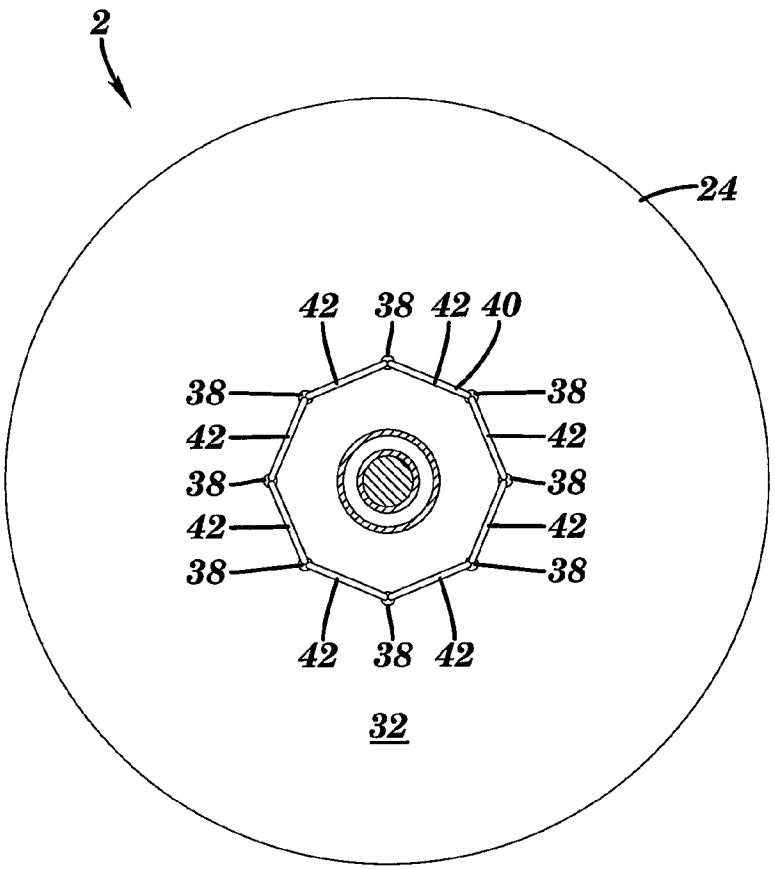
FIG. 2 is a side view showing the tether-facing surface of one of the side units of the yo-yo shown in FIG. 1A, taken at the plane labeled 2-2 in FIG. 1A.

As shown in FIGS. 1-3, a string 40 is threaded through the apertures 38 in a manner whereby said string forms eight contiguous tether engagement pads 42 that are located on the body member's tether-facing surface 32. The string 40 is preferably structurally, and materially, identical to the yo-yo's tether 6, wherein it has a round cross-section when in a free state and is manufactured from a plurality of strands that are wound together. The string 40 will however most likely be shorter in length than tether 6. Preferably, both the string 40 and the tether are made of a cotton material and each has a diameter of between about 0.050 and 0.1 inch. While a single string is shown being used to form all eight pads 42, a user can instead employ multiple strings 40 whereby each string could be used to form one, or more, of the pads 42.

While the string 40 is preferably made of multiple strands of cotton, the string 40 can alternatively be made from a single strand/member, have a different thickness, be made from a different material, have a non-circular cross-section and/or have different surface characteristics. For example, the string can be made from a single strand polyester material that has a smooth surface. As another example, the string can be made from a rubber material, such as a rubber band, that has a square cross-sectional shape. As another alternative, multiple strings, of the same or different materials, may be threaded through the apertures 38 whereby each pad 42 would be formed from said multiple strings. A string is herein defined as an elongated, flexible, cord-like member.

Each of the tether engagement pads 42 formed by the string 40 is preferably an elongated, linear body that has a longitudinal axis substantially perpendicular to a radius of the side unit. The pad preferably has, in cross-section, an arcuately-shaped outer surface that faces the yo-yo's tether.

FIG. 1B provides a magnified view of an end portion of one of the pads 42. In said figure, the pad is shown having a flat surface in contact with surface 32, a somewhat flattened arcuately-shaped tether-facing surface 44, an arcuately-shaped top surface 46 and an arcuately shaped bottom surface 48. As can be seen in the figure, due to the fibrous nature of the string, a number of fibers 50 will normally extend outwardly from the pad.

It should be noted that since each pad 42 is fashioned from a flexible string, the shape of the pad will vary depending on the degree to which the string is stretched. It should also be noted that the pad's exposed surfaces 44, 46 and 48 are preferably much rougher than the smooth, surrounding tether-facing surface 32 of the body member. The relatively rough surface helps to enable a locking engagement between the pad and the yo-yo's tether.

In the preferred embodiment, a single, unbroken length of string is employed to create the plurality of pads 42. To achieve the pad layout as shown, one half of the string is first threaded through one of the apertures 38. That half of the string is brought over surface 32 to the next adjacent aperture 38, while the other half of the string is brought over surface 34 to the same next adjacent aperture 38. The two halves of the string are then threaded through that aperture 38, thereby creating a first pad 42, and a similar pad of string on the body member's surface 34. An oval loop of string is thereby formed that extends between each pair of apertures. It should be noted that each of the apertures 38 is preferably sized to enable thru-passage of at least two portions of string 40, wherein said string portions may be in a compressed/stretched state.

To continue threading yo-yo 1, the first string portions are then brought over the adjacent surfaces 32 or 34 to the next aperture, to create another pad 42 and another similar pad on surface 34. This threading procedure is preferably continued until all eight pads 42 are formed. It should be noted that when the string is threaded through the apertures 38 in the manner shown in FIG. 2, all eight pads 42 will have contiguous ends whereby the pads are not spaced apart. The contiguous pads together form a hexagonal, ring-shaped tether engagement structure that has an arcuately-shaped surface that faces into the yo-yo's string gap.

At the completion of the threading procedure, the string's two end portions 52 are preferably located adjacent an outwardly-facing surface of the side unit. FIG. 3 shows the string's end portions 52 located adjacent the body member's surface 34 where they are tied together to form a knot 54. Other methods may be employed to secure together the string's end portions, including adhesives, fasteners and interlocking securement portions.

Figure 4:
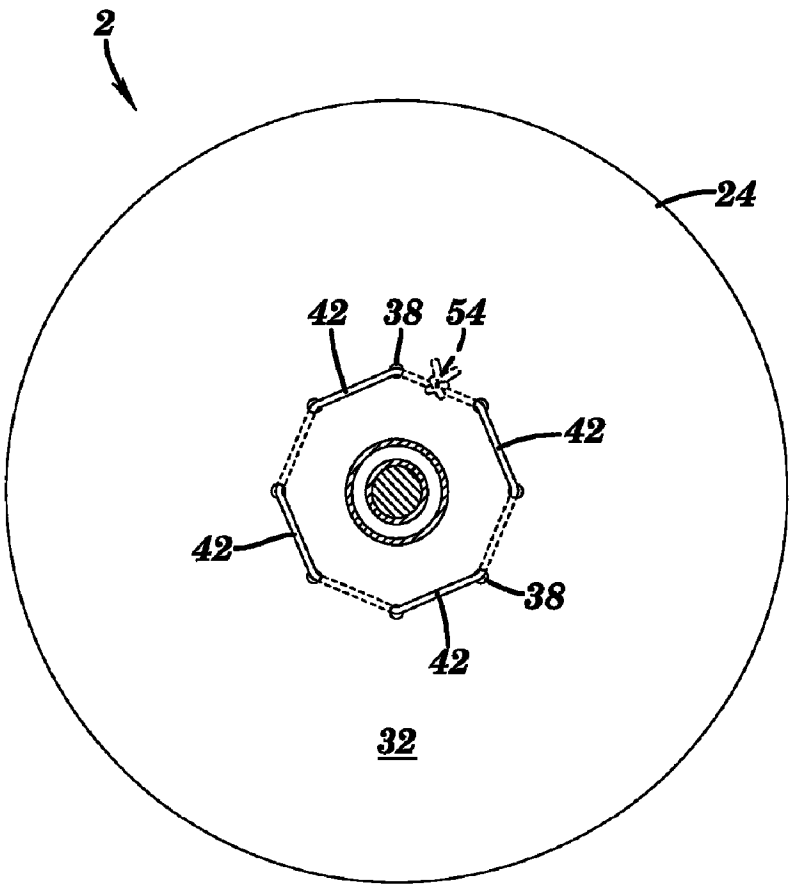
FIG. 4 is a side view similar to FIG. 2, but shows the tether-facing surface of the side unit when an alternate threading pattern is employed.

FIG. 4 shows an alternate manner in which the string 40 can be threaded through the apertures 38 in the body member 24. As shown, the string can be threaded to form four tether engagement pads 42 that are each identical to a pad 42 of the first embodiment. It should be noted that this threading pattern results in the pads 42 being spaced apart from each other. To achieve the pad pattern shown in this figure, one end of the string is initially threaded through an aperture 38 from a location adjacent surface 34. The string is then drawn across surface 32, through the next aperture 38, then across surface 34 (shown in phantom) again to the next aperture 38. Unlike the previous embodiment, an oval loop of string is not formed between adjacent apertures 38.

Figure 5:
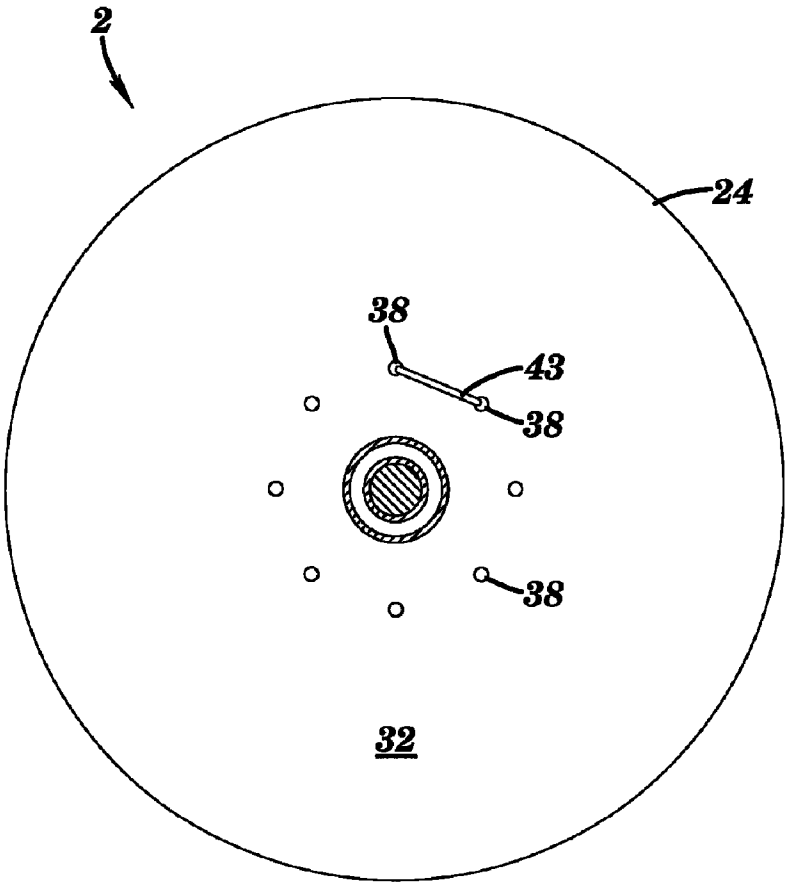
FIG. 5 is a side view similar to FIG. 2, but shows the tether-facing surface of a side unit when another alternate threading pattern is employed.
Figure 6:
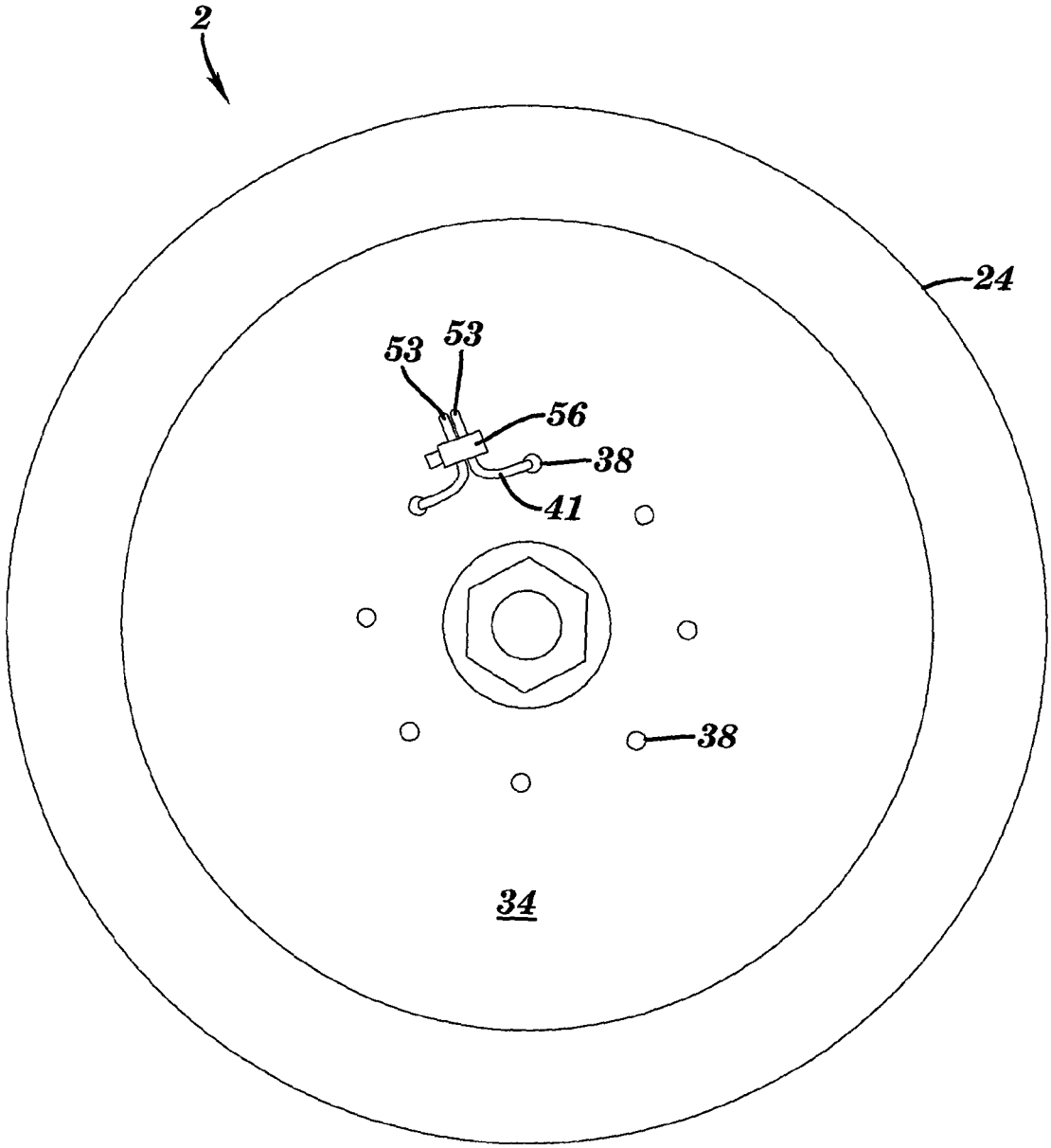
FIG. 6 is a side view similar to FIG. 3, but shows the outwardly-facing surface of the side unit shown in FIG. 5.

FIGS. 5 and 6 show another alternate manner in which the string can be threaded through the apertures 38 in the body member 24. These figures also show the use of an alternate type of string 41. While string 41 has a diameter similar to that of the fibrous string 40 shown in the previous embodiment, it differs in that it is made of a resilient rubber material. As shown, string 41 is threaded through only two of the apertures 38 and thereby forms a single tether engagement pad 43. Pad 43 is identical to a pad 42 of the first embodiment, except that it is made of a rubber material.

FIG. 6 provides a view of the outwardly-facing surface of a side unit per FIG. 5. As shown, the string's end portions 53 are fastened together using a conventional barrel-lock fastener 56. It should be noted that any type of fastener commonly employed to positionally secure two string portions may be employed to secure together the end portions of the string 41 (or string 40 of yo-yo1).

Figure 7B:
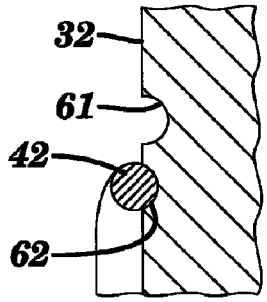
FIG. 7B shows a magnified portion of FIG. 7A, with portions shown in phantom.
Figure 7A:
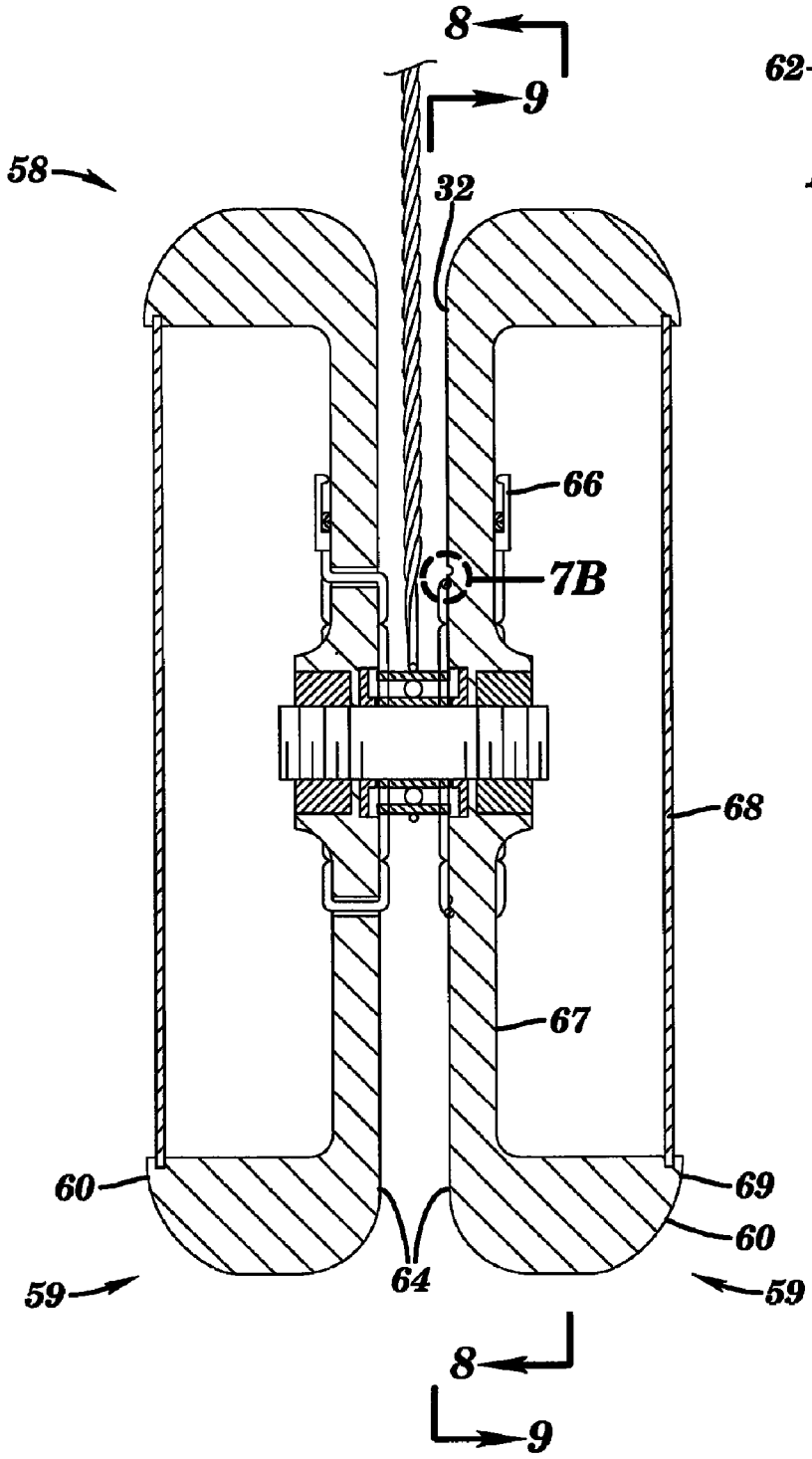
FIG. 7A is a cross-sectional front view of an alternate embodiment of a yo-yo in accordance with the invention.
Figure 9:
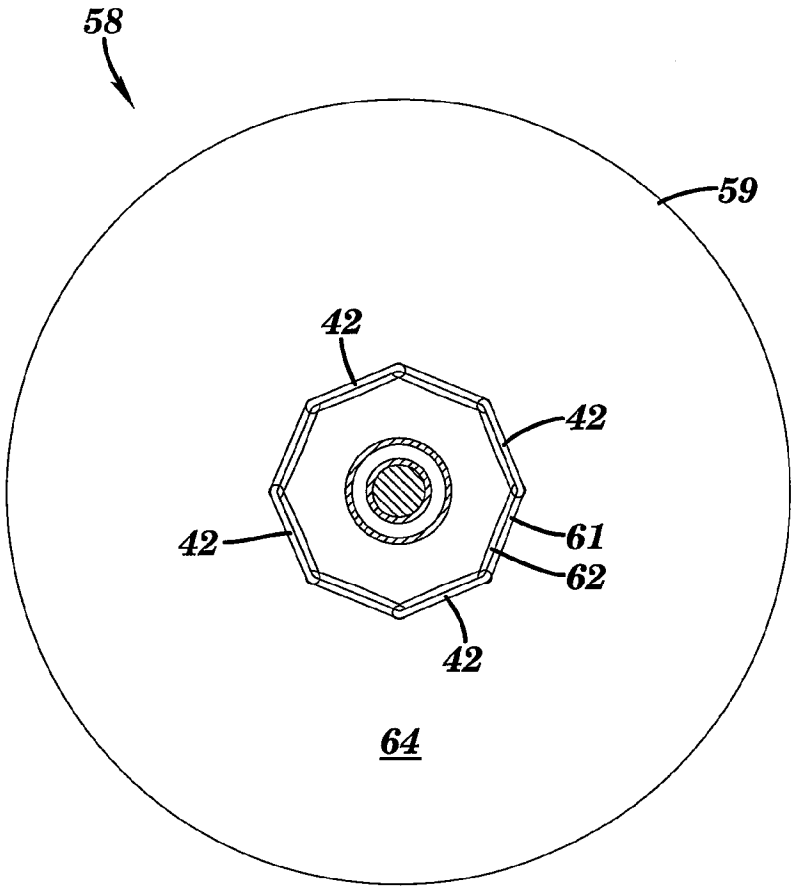
FIG. 9 shows the tether-facing surface of one of the side units shown in FIG. 7A, taken at the plane labeled 9-9 in FIG. 7A.
Figure 8:
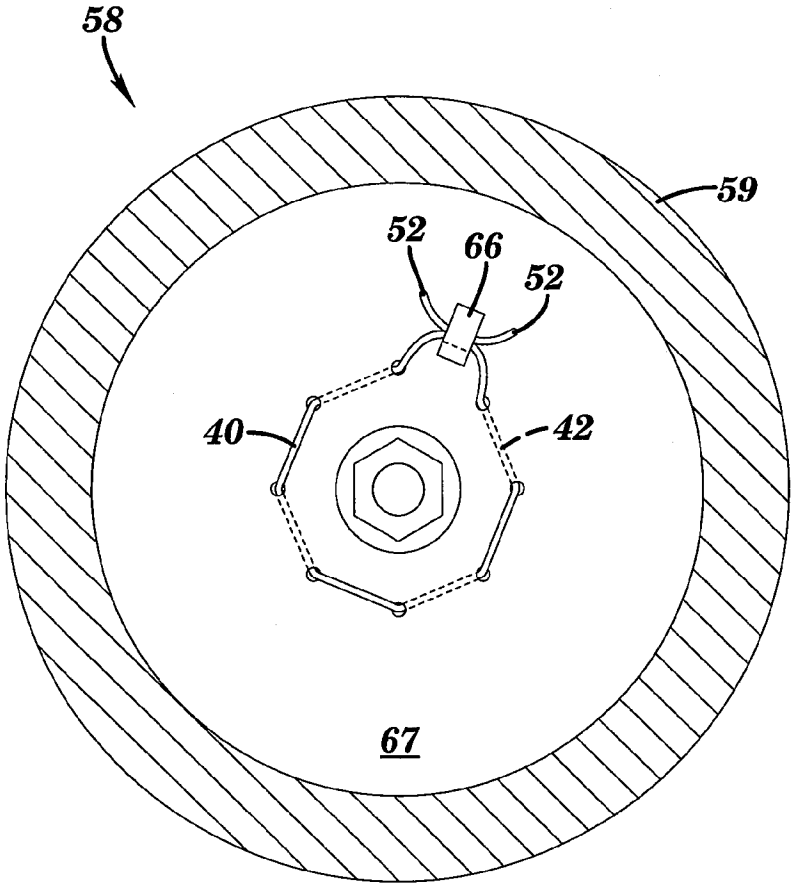
FIG. 8 shows the outwardly-facing surface of one of the side units shown in FIG. 7A, taken at the plane labeled 8-8 in FIG. 7A.

FIGS. 7-9 show another yo-yo 58 in accordance with the invention. Yo-yo 58 has two side units 59, wherein each side unit has a body member 60 that is similar to body member 24 of yo-yo 1. Unlike the previous embodiment, each body member 60 includes two grooves, 61 and 62, located on its tether-facing surface 64. Body member 60 also includes an integral, or attached, 'L'-shaped string clamp member 66 located in close proximity to its outwardly-facing surface 67.

Each of grooves 60 and 61 is semi-circular in cross-section and forms an octagon on surface 64. Groove 60 preferably has a different depth than groove 61. Located at each corner of the hexagons formed by the grooves is an aperture 38, thereby enabling the string 40 to be located within either groove. As a result, when the string is located within one groove, it will extend into the yo-yo's string gap by a different amount than it would if it was received within the other of said grooves. While each groove is shown forming an octagonal shape, said grooves may be located to form other shapes, including circles or squares. In addition, a greater, or lesser, number of grooves may be employed. Furthermore, while a single ring of apertures 38 is employed with each aperture extending through both grooves, multiple rings of apertures 38 may instead be employed whereby each groove has its own dedicated set of apertures. While not shown, both grooves may have identical depths, wherein placement of the string in one groove or another will change the yo-yo's responsiveness due to changes in the length and position of the tether engagement pads.

As shown in FIG. 7, the space formed between the clamp member and surface 67 is preferably narrower than the thickness of the string's end portions. As a result, after the string has been threaded through the apertures 38, the string's end portions can be secured by pulling them into said space between the clamp member 66 and surface 67.

Each side unit 59 may optionally include a removable cap 68. The cap is preferably made of a semi-rigid plastic material and engages a complementary groove 69 in the body member. A similar cap arrangement may be employed in yo-yo 1.

Figure 10:
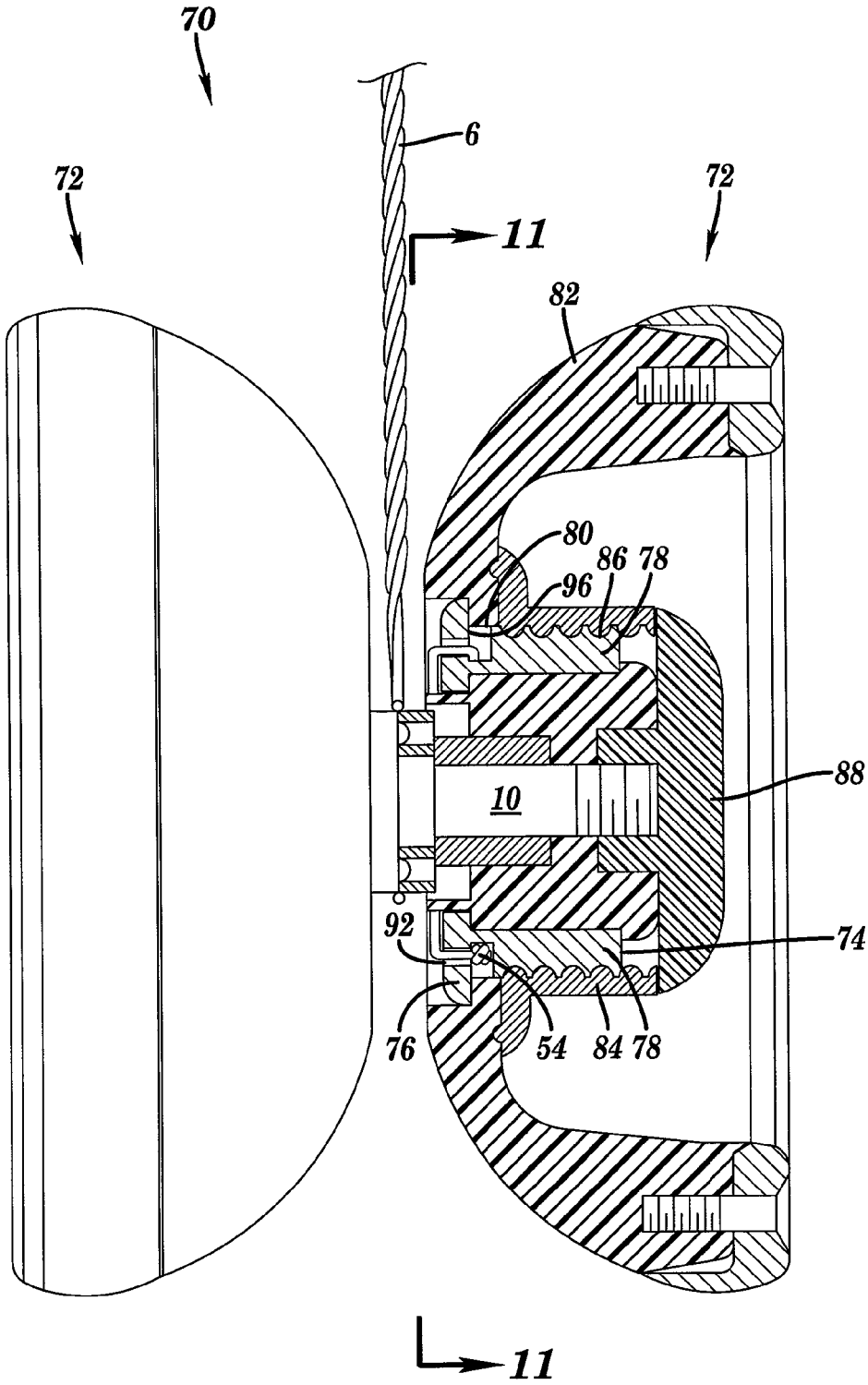
FIG. 10 is a front view, with the right-hand portion shown in cross-section, of an alternate embodiment of a yo-yo in accordance with the invention.
Figure 11:
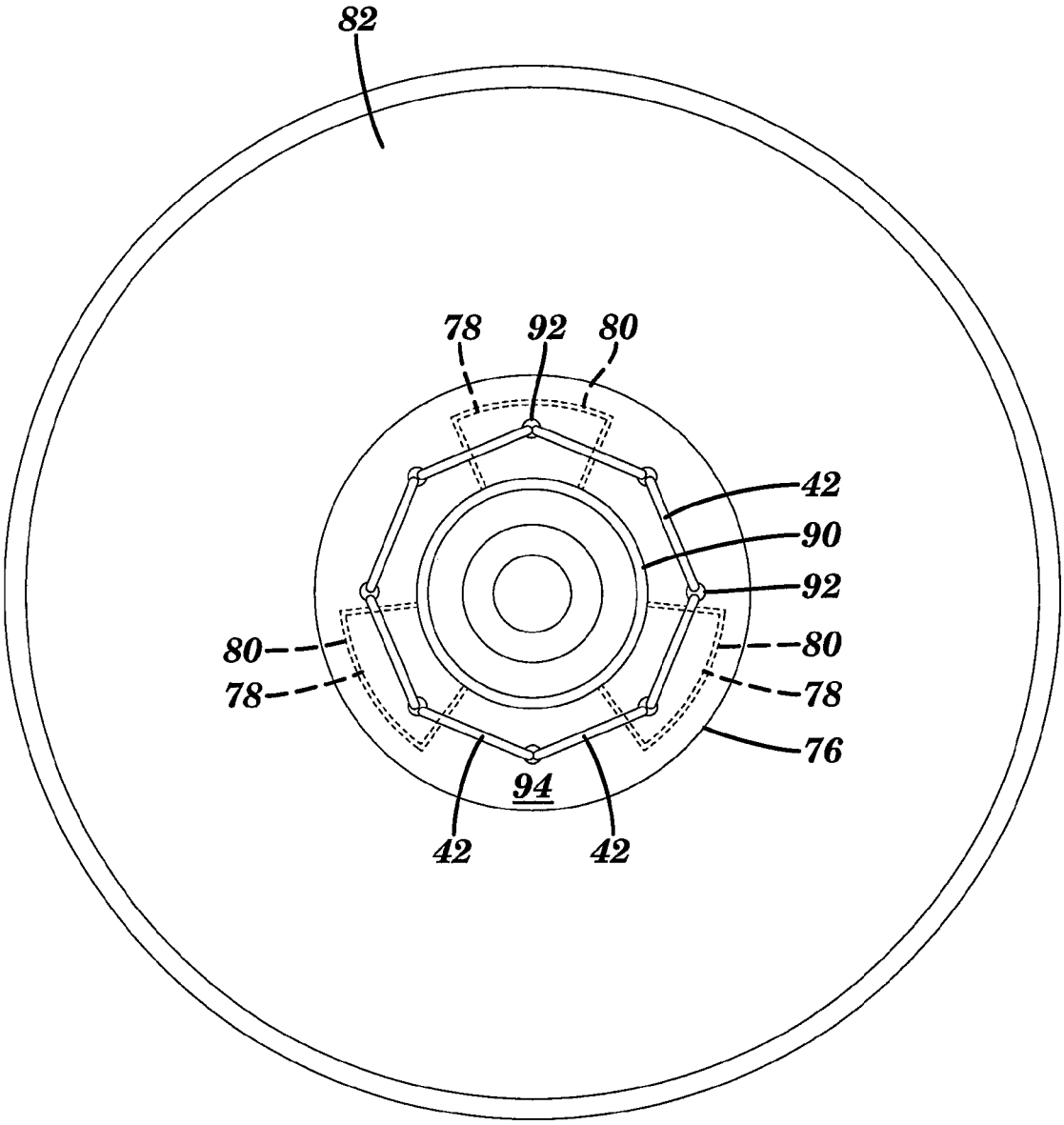
FIG. 11 shows the tether-facing surface of one of the side unit's of the yo-yo shown in FIG. 10, taken at the plane labeled 11-11 in FIG. 10.

FIGS. 10 and 11 show another embodiment of a yo-yo 70 in accordance with the invention. Yo-yo 70 has two side units 72 that are preferably identical to each other and are secured together via an axle pin 10. Each side unit includes a centrally-located shuttle member 74 that has a cylindrical head portion 76 and three outwardly-extending legs 78. The shuttle member is movably secured to the side unit by virtue of the shuttle's legs fitting through complementary apertures 80 in the side unit's body member 82. A rotatable nut 84 having interior threads is engaged to threads 86 formed on the exterior of the shuttle member's legs. The nut is preferably rotatably secured to the side unit via a cap nut 88 that is threadedly secured to the axle pin's threads 14. By rotating the nut 84, a user can cause the shuttle member to either move closer to, or further away from, the yo-yo's tether 6. The shuttle's degree and direction of movement is dependent on the amount and direction of the nut's rotation.

The shuttle member's head portion 76 includes a central thru-bore 90 and a plurality of apertures 92 that are sized similarly to apertures 38 of the first embodiment. A length of string 40 is threaded through said apertures to form a plurality of tether engagement pads 42 located on a tether-facing surface 94 of said head portion. The string is preferably threaded through the apertures 38 in a similar pattern to that for yo-yo 1, and has its end portions secured together by a knot 54 located adjacent an outwardly-facing surface 96 of the shuttle's head portion.

A third embodiment of a yo-yo 100 in accordance with the invention is shown in FIGS. 12-15. Yo-yo 100 includes two side units 102 that are preferably substantially identical to each other and are secured together in a spaced-apart relation by an axle structure 4. A tether 6 is shown secured to a center portion of the axle structure.

Each side unit 102 features a disk-shaped body member 106 that has a tether-facing surface 108, an outwardly-facing cavity 110 and a center bore 112. A hub portion 114 of the body member is located at the center of cavity 110 and surrounds a portion of the center bore.

Located adjacent the hub portion 114, and preferably at least partially located within cavity 110, is a button member 116. Attached to the button member are a plurality of string securement members in the form of elongated hook members 118. Each hook member has a curved end portion 120 that extends through a complementary aperture 122 in the body member. While end portion 120 is not in the form of a continuous circle, the partially enclosed area 124 within portion 120 is herein considered to be an aperture.

It should be noted that while the button member and hook members are shown as a unitary part, they may alternatively be separate parts that are connected together. Also, while end portion 120 is shown having a shape similar to a 'J', it may alternatively have a different shape, including a full circle or cylinder that has a center-located aperture.

Each side unit 102 also includes a spring member 126 that is preferably also located within cavity 110. The spring member is sandwiched between a portion of the button member and the body member's hub portion 114 whereby it functions to bias the button member, and the hook members, in an outward direction.

A removable cap 128 is secured to the body member 106 via a shaped peripheral edge 130 that fits into a complementary groove 132 in the in the body member. The cap overlies cavity 110 and includes a center-located aperture 134. Besides covering cavity 110, the cap functions to secure the button member to the side unit by virtue of a lip 136 of the button member contacting an inwardly-facing surface 138 of the cap adjacent aperture 134.

Figures 12, 13:
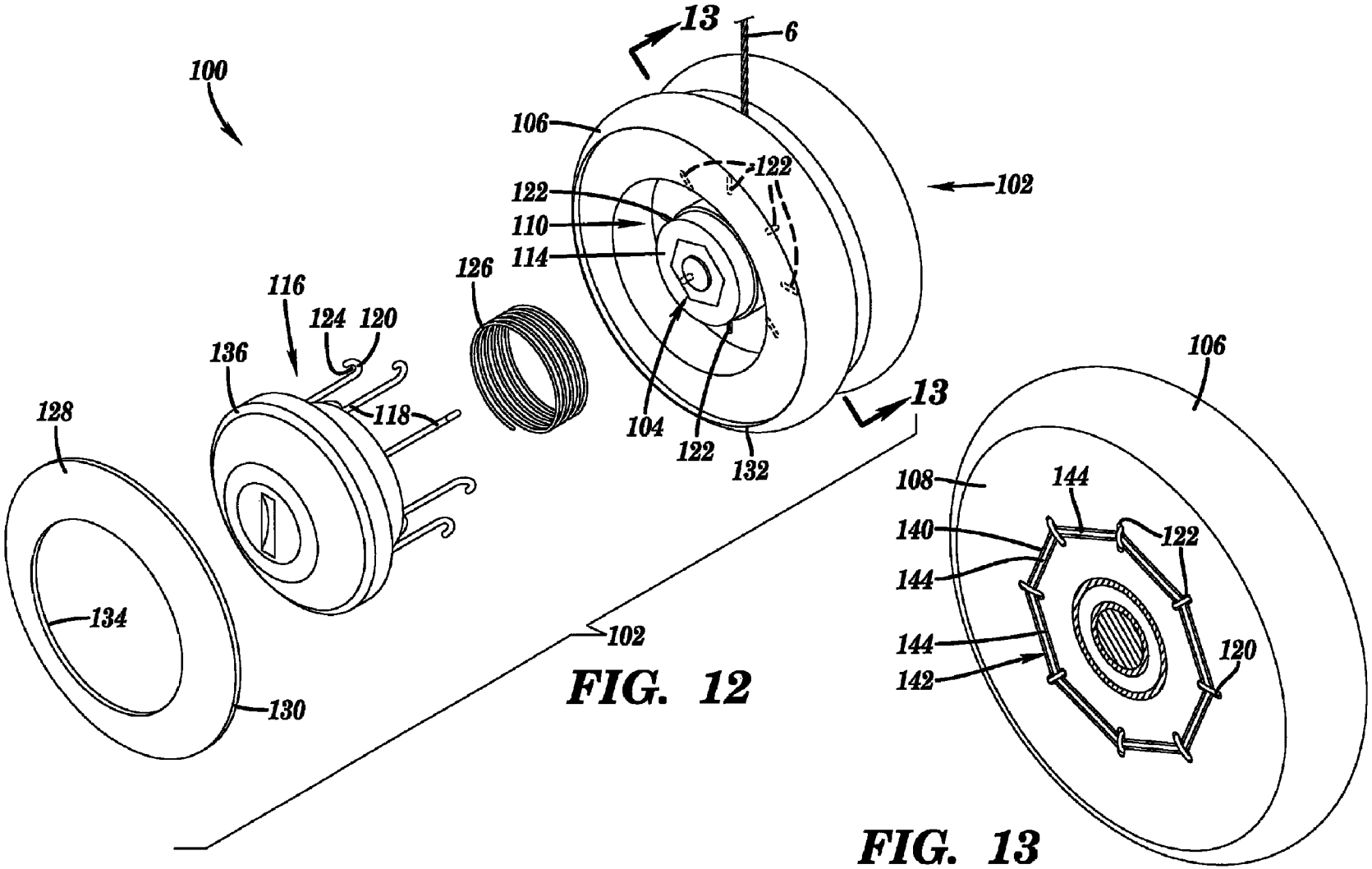
FIG. 12 is an isometric, partly-exploded view of another alternate embodiment of a yo-yo in accordance with the invention.
FIG. 13 shows the tether-facing surface of one of the side units of the yo-yo shown in FIG. 12, taken at the plane labeled 13-13 in FIG. 12.

In FIG. 13, one can see that the body member's tether-facing surface 108 includes a shaped groove 140 into which is located a loop of string 142. The groove is preferably fairly shallow, whereby a portion of the string extends outwardly from said groove. String 142 is preferably in the form of a continuous loop, and is preferably identical in material and structure to the yo-yo's tether. The yo-yo has tether engagement pads 144 formed by the segments of the string 142 located between portions 120 of the hook members. Pads 144 have the same basic shape and function as the tether engagement pads 42 of the previously described embodiments of the invention.

Figure 15:
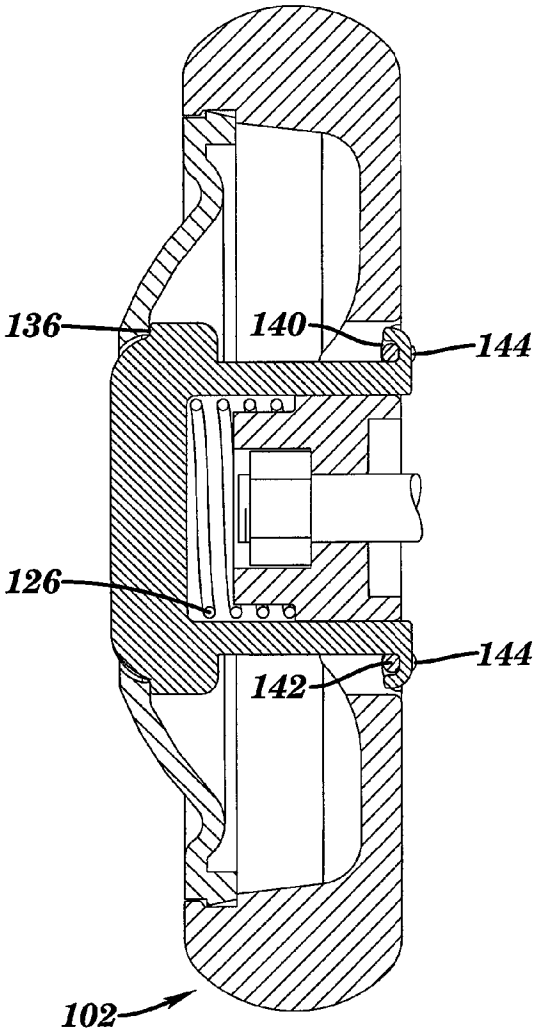
FIG. 15 is a cross-sectional view of the same side unit shown in FIG. 14, but the button member is shown in an extended position.
Figure 14:
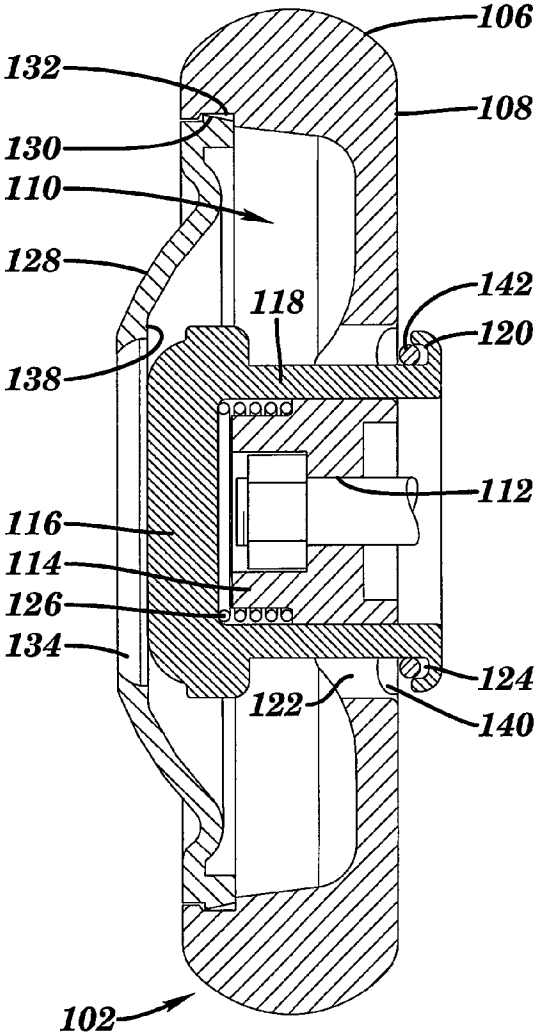
FIG. 14 provides a cross-sectional view of one of the side units shown in FIG. 12 and shows the button member in a depressed condition.

FIGS. 14 and 15 show how the loop of string 140 is initially secured to the body member. A user would first press the button member in an inward direction until it is in the position shown in FIG. 14. One should note that the movement of the button member has caused the curved end portion 120 of each hook member to move away from the body member's tether-facing surface 108, thereby allowing access to the portion's aperture/area 124. The figure shows the loop of string at a point after it has been placed into the groove 140 and threaded through the apertures 124 of the hook members.

FIG. 15 shows the button member after it has been released and the spring member 126 has caused it to move to its outermost position. In the position shown, the hook member's end portions are once again received into the body member whereby they secure the loop of string against the bottom of the groove 140.

In all of the embodiments described herein, the basic interaction between the tether and the tether engagement pads is basically the same. When the tether is unwound from about the yo-yo's axle structure and the yo-yo is spinning, sideways movement of a tether portion can cause said tether portion to contact one, or more, of the yo-yo's tether engagement pads, 42 or 144. This will result in either the tether briefly rubbing on, then moving away from, the pad(s), or the yo-yo returning to the user's hand due to the pad(s) causing the tether to become lockingly engaged to one of the spinning side units. The locking engagement is a result of the tether portion actually getting caught on one of the pads and/or its contact with a pad causing a bunching up of the tether against the tether-facing surface of one, or both, of the side units.

The shape of the tether engagement pads taught herein minimizes inadvertent locking engagements with the tether, while at the same time, facilitates a locking engagement when a user desires such to occur. Referring again to FIG. 1B, each pad has a tether-facing surface 46 that, while being somewhat flattened due to the tension in the string, has an arcuate shape. As a result, the surface has a sufficiently large contact area to enable a locking engagement with the tether, but said area is small enough whereby it is not overly easy for an inadvertent contact with the tether to occur. The curvature of surface 46 also provides a distinct advantage over the prior art since said curvature will tend to cause the tether to bounce off the pad should a slight inadvertent contact occur.

A minimization of inadvertent locking engagements with the tether, and a facilitation of desirable locking engagements, is also achieved by the pad's arcuately-shaped top and bottom surfaces, 46 and 48 respectively. When a user wants the yo-yo to return, he or she will purposefully cause the tether to go slack, whereby one or more portions of the tether will move to the side and assume a curved shape. The shape of surfaces 46 and 48 will tend to match the shape of the contacting tether portion, thereby increasing the probability of a locking engagement to occur. Conversely, when the tether is in a taut condition, the chances for an inadvertent or locking engagement between the tether and a pad is minimized due to the fact that the taut tether will normally not be capable of contacting surfaces 46 and 48 of the pad. This effectively minimizes the pad surface available for an inadvertent engagement with the tether.

A yo-yo having the response system disclosed herein provides a user with multiple methods for changing the yo-yo's responsiveness. A user can change the tension in the string that forms the pads; replace said string with a different string; reposition said string; or for yo-yo's having multiple grooves, rethread said string so that the pads are located in a different groove.

To increase the tension in the string of yo-yo 1 (a similar procedure would be employed with yo-yo 70, or when a fastener per FIG. 6 is employed), a user unties the knot 54, pulls on the string's end portions 52, and then reties the knot. This causes the tether engagement pads to flatten against the body member's tether-facing surface 32, thereby decreasing the thickness of the pad. This results in a decrease in the yo-yo's responsiveness due to an increase in the distance that any tether portion must travel to contact a pad.

To decrease the string tension, a user unties the knot 54 and then either allows the string to loosen on its own, or applies pressure on the pads 42 to pull more of the string onto the tether-facing surface. As a result, the pads 42 become less compressed, whereby they will bulge outwardly toward the tether. This increases the yo-yo's responsiveness since the resultant decrease in the distance between the tether and pads decreases the distance that the tether must travel in order to contact a pad.

For yo-yos 58 and 100, changing the yo-yo's responsiveness via a change in string tension works in the same way as in yo-yo 1. In yo-yo 58, this is achieved by first disengaging the string's end portions from the clamp member. Said end portions are then pulled tighter to decrease responsiveness, or allowed to loosen to increase responsiveness. They are then secured by reinserting them into the clamp member.

In yo-yo 100, the procedure to change the string tension is quite different. To increase string tension, one pulls on the button member 116. This stretches the string and thereby causes the pads to flatten for a period of time. To decrease the tension in the string, a user presses the button member inwardly, and then slowly releases the button member. This will allow the string to expand whereby the pads will bulge outwardly for a period of time.

For yo-yo 100, another method is also available for changing the tension in the string that forms each side unit's tether engagement pads. A user can change the string tension by removing the string and the side unit's cap, and then exchanging the side unit's spring member with another spring member that has a greater, or lesser, spring constant. Once reassembled, the string will have a tension concomitant with the new spring constant.

Changing yo-yo responsiveness via a replacement of the string involves the same procedure as is used for replacing the string when the pads become worn. The existing string is removed from the yo-yo's apertures, and a new string is installed in its place. As described previously, the physical characteristics of the new string will affect the yo-yo's responsiveness. For example, a user can remove a string and replace it with a thicker, thinner, or less worn, string made from the same material. This will change the size of the tether engagement pads, and thereby change the yo-yo's responsiveness in the same manner as changing the string tension. As another example, a user can remove a string made of one material and replace it with a string made of a different material. For example, changing from a cotton string to a polyester string, or a rubber string to a polyester string, will decrease the yo-yo's responsiveness due to the increased smoothness/lower relative friction coefficient of the tether engagement pads.

Changing the yo-yo's responsiveness via a repositioning of the string used to form the tether engagement pads is an inherent advantage of the invention. Once the tether engagement pads become worn, a user can reposition the string so that different portions of the string are then employed to form the tether engagement pads.

For the embodiments of the invention in which the string has two end portions, the string is repositioned by first freeing the string's end portions. The user then re-threads the string through the body member's apertures in a manner whereby different portions of the string form the tether engagement pads. The string's end portions are then re-secured. In a case where the tether engagement pads have become worn, repositioning the string can provide the yo-yo with "like-new" responsiveness.

For the yo-yo embodiment in which a continuous loop of string is employed, repositioning of the string is extremely easy. The user applies pressure to the button member until the hook members 118 move toward the yo-yo's tether. This reduces the tension on the string. The user then rotates the loop of string so that portions of the string that were located in apertures/areas 142 of the hook member's end portions become exposed and are then positioned whereby they form a center portion of each tether engagement pad.

To change the responsiveness of a yo-yo having multiple grooves of different depths for the string, the string's end portions are first freed. The string is then loosened, placed into a groove having a different depth, and then re-secured. The change in groove depth will cause the tether engagement pads to be positioned closer to, or further from, the tether, thereby changing the yo-yo's responsiveness in a manner similar to that achieved by changing the string tension.

It should be noted that the response system taught herein may be employed with other types of yo-yos than the ones shown. Furthermore, while only a few different string threading patterns have been shown and described, other threading patterns may be employed to provide different tether engagement pad configurations without departing from the spirit of the invention. It should also be noted that while each yo-yo taught herein is shown having identical side units, non-identical side units might be employed in the same yo-yo. For example, a yo-yo may have one side unit that features different numbers, types, or patterns, of tether engagement pads/members than the yo-yo's other side unit. In addition, while some embodiments of the invention taught herein employ one or more grooves for the string that forms the tether engagement pads, the use of grooves is optional. One or more of said grooves may be included in the tether-facing surface of any, or all, of the yo-yo side units described herein.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A yo-yo comprising:

first and second side units secured together in a spaced-apart relation by an axle structure;

a tether secured to a portion of said axle structure; and wherein said first side unit comprises a member, a string and a plurality of securement members, wherein said member includes a front surface and a rear surface, wherein said front surface faces said second side unit, wherein said member includes a plurality of apertures through which said securement members extend, wherein said string is secured to said member at multiple spaced-apart locations by the securement members in a manner whereby said string is predominantly located on said front surface and forms a plurality of tether engagement pads located on said front surface and wherein when said yo-yo is sleeping, said pads are capable of facilitating a return of said yo-yo to a user's hand.

2. A yo-yo comprising:

first and second side units secured together in a spaced-apart relation by an axle structure;

a tether secured to a portion of said axle structure; and wherein said first side unit comprises a first member, a string and a plurality of securement members, wherein said first member includes a front surface and a rear surface, wherein said front surface faces said second side unit, wherein said securement members are operatively connected to said first member, wherein said first member includes a plurality of apertures through which said securement members extend, wherein said securement members engage said string at spaced-apart locations in a manner whereby said string forms a plurality of tether engagement pads located on said front surface and wherein when said yo-yo is sleeping, said pads are capable of facilitating a return of said yo-yo to a user's hand.

3. The yo-yo of claim 2 wherein said string and said tether are both made of the same material.

4. The yo-yo of claim 2 wherein said string and said tether are both made of a fibrous material.

5. The yo-yo of claim 2 wherein said string comprises a plurality of strands that are twisted together.

6. The yo-yo of claim 2 wherein said string is made of a resilient material.

7. The yo-yo of claim 2 wherein said plurality of tether engagement pads includes a first tether engagement pad and a second tether engagement pad, and wherein a location where said string is secured to said member by one of said securement members forms an end point for both of said first and second engagement pads.

8. The yo-yo of claim 2 wherein said front surface includes at least one groove into which said string is at least partially received.

9. The yo-yo of claim 2 wherein a plurality of said securement members have apertures through which said string extends.

10. A yo-yo comprising:

first and second side units secured together in a spaced-apart relation by an axle structure;

a tether secured to a portion of said axle structure;

a first member that forms a portion of said first side unit and includes a front surface that faces the second side unit;

a second member that forms a portion of the first side unit, and wherein said second member is movable relative to said first member;

a plurality of string securement members operatively connected to said second member;

a plurality of apertures in said first member through which a plurality of the string securement members extend; and a string secured to said front surface of said first member by a plurality of said string securement members, and wherein portions of said string form tether engagement pads that are capable of facilitating a return on command of the yo-yo when said yo-yo is sleeping.

11. The yo-yo of claim 10 wherein an end portion of at least one of said string securement members is hook-shaped.

12. The yo-yo of claim 10 wherein said first side unit also includes a spring that biases said second member in a direction away from said second side unit, and wherein said second member can be moved by a user toward said second side unit.

13. The yo-yo of claim 10 wherein said front surface of the first member includes a groove into which the string is at least partially received.

14. The yo-yo of claim 10 wherein said pads have an arcuately-shaped surface that faces said second side unit.

15. A yo-yo comprising:

first and second side units;

an axle structure that secures together said first and second side units in a spaced-apart relation, and wherein a tether can be secured to a portion of said axle structure;

wherein said first side unit has a surface that faces said second side unit and wherein said surface includes a plurality of spaced-apart apertures;

a plurality of securement members secured to a portion of said first side unit, and wherein each of said securement members extends through a different one of said apertures; and an elongated flexible member secured to said first side unit at spaced-apart locations by said securement members, wherein said flexible member forms at least one pad member located on said surface of said first side unit, and wherein when a tether is secured to said axle structure and said yo-yo is sleeping, said tether is capable of engaging said at least one pad member in a manner that will result in said tether winding about said axle structure.

16. The yo-yo of claim 15 wherein each of a plurality of said securement members has a hook-shaped end portion through which said flexible member extends.

17. The yo-yo of claim 15 wherein said apertures are located in a disk-shaped body and wherein said apertures are thru-bores that extend through said body.

18. The yo-yo of claim 15 wherein said at least one pad member has first, second, third and fourth surface portions, wherein said first surface portion faces said surface of said first side unit, wherein said second surface portion is arcuately-shaped and faces away from the yo-yo's axle structure, wherein said third surface portion is arcuately-shaped and faces toward said axle structure, and wherein said fourth surface portion is arcuately-shaped and faces toward said second side unit.

19. A yo-yo comprising:

first and second side units;

an axle structure that secures together said first and second side units in a spaced-apart relation, and wherein a tether can be secured to a portion of said axle structure;

wherein said first side unit has a first surface that faces said second side unit and a second surface that faces away from said second side unit, and wherein said first side unit also has a member that includes a plurality of apertures; and a plurality of tether engagement pads located on said first surface and secured to said member, wherein each of said pads is formed by an elongated flexible string that extends through said member and has end portions located adjacent said second surface, and wherein when a tether is secured to said axle structure and said yo-yo is sleeping, said tether is capable of engaging at least one of said tether engagement pads in a manner that will result in said tether winding about said axle structure.

* * * * *